United States Patent [19]

Bagusche

[11] 4,296,620

[45] Oct. 27, 1981

[54] SMOOTHING ROLLING MILL

[75] Inventor: Siegfried Bagusche, Loevenich, Fed. Rep. of Germany

[73] Assignee: W. Hegenscheidt Gesellschaft mbH, Erkelenz, Fed. Rep. of Germany

[21] Appl. No.: 77,995

[22] Filed: Sep. 24, 1979

[30] Foreign Application Priority Data

Oct. 16, 1978 [DE] Fed. Rep. of Germany ..... 2844974

[51] Int. Cl.[3] ..... B21D 19/00

[52] U.S. Cl. ..... 72/100; 72/110

[58] Field of Search ..... 72/86, 87, 100, 110

[56] References Cited

U.S. PATENT DOCUMENTS 3,625,263 12/1971 Kopczynski ..... 72/110

3,632,273 6/1972 Savickas ..... 72/110

*Primary Examiner*—James G. Smith

*Attorney, Agent, or Firm*—W. G. Fasse; D. F. Gould

[57] ABSTRACT

The feed advance capacity of smoothing rollers in a smoothing rolling mill is utilized to the fullest possible extent by displacing the smoothing rollers relative to each other in the axial direction so that the facing ends of the smoothing rollers are located in different planes extending radially relative to the longitudinal, rotational axis of the work piece. The direction of rotation of one of the smoothing rollers is taken into account and the length of displacement is calculated by a formula.

8 Claims, 7 Drawing Figures

SMOOTHING ROLLING MILL

BACKGROUND OF THE INVENTION

The invention relates to a smoothing rolling mill, more specifically, to such a rolling mill tool having at least two smoothing rollers, whereby the connecting line between the roller centers of two neighboring rolls and the center of curvature of the work piece surface to be smoothed differs from 180° and wherein the smoothing rollers are unevenly distributed about the circumference of the work piece.

Rolling mill tools of the type just referred to are known in the art, for example, as disclosed in German Pat. No. 1,294,910 especially FIGS. 1 to 4, and German Pat. No. 1,294,325, especially FIGS. 1 to 3. Tools of this type are further known from an article or brochure entitled "Glattwalzen" (Smooth Rolling), by Dr. Eng. Helmut Koenig published on 1954 in "Das Industrieblatt", page 44, FIG. 28 by Deutscher Fachzeitschriften- und Fachbuchverlag GmbH Stuttgart in the series "Schriftenreihe Feinbearbeitung". A smooth rolling apparatus of the described type is also disclosed in a dissertation or thesis filed on Sept. 25, 1972 by Paul Neese with the Institute of Technology at Braunschweig, Federal Republic of Germany under the title: "Steps for Reducing the Unroundness of Smooth Rolled Work Pieces", see especially FIG. 25.

A brochure published by W. Hegenscheidt GmbH and entitled "Centerless Smooth Rolling Machine", type 7489 (B1/O) also illustrates smooth rolling tools of the type here involved.

German Pat. No. 1,131,545 describes a smooth rolling apparatus in which the smoothing rollers are arranged with a slight angularity relative to the central longitudinal axis of the work piece in order to improve the feed advance capability of the smoothing rollers.

Smoothing roller tools which also work to provide the necessary feed advance of the work piece must be so constructed that they provide a throughput capability as large as possible in order to work efficiently and hence economically. Stated differently, the work piece to be smoothed must be completely finished as quickly as possible. The feed advance capability of a tool may be the higher the more smoothing rollers are simultaneously operational. This is so because the feed advance capacities of all the individual smoothing rollers are added up to provide the total sum of the possible feed advance. However, certain structural requirements which are unavoidable, call simultaneously for a smooth rolling apparatus as described above. In other words, the required tool structure is such that each individual smoothing roller effective on the work piece is not capable of delivering its full feed advance capacity because due to the arrangement of the rollers an overlap between the working ranges of the individual smoothing rollers occurs. The extent of the overlap reduces or diminishes the feed advance capacity.

In the mentioned prior art the smoothing rollers operating on the work piece may be arranged in a tool carrier which is common for all rollers. In the alternative, individual and/or groups of smoothing rollers may be arranged in partial tool components so that the smoothing roller tool will comprise a plurality of partial tools in the latter instance.

OBJECTS OF THE INVENTION

In view of the above it is the aim of the invention to achieve the following objects singly or in combination:

to improve a smooth rolling tool or apparatus of the type described bove in such a manner that in spite of the mentioned arrangement of the smoothing rollers relative to the work piece, the full feed advance capability of each individual smoothing roller may be utilized;

to use the maximum feed advance capability of each individual smoothing roller even when the smoothing roller tool comprises a plurality of partial roller holding tools; and to axially displace the smoothing rollers relative to each other by a precise extent as will be described in more detail below.

SUMMARY OF THE INVENTION

According to the invention the above objective has been achieved by displacing one roller relative to another or relative to other rollers in the axial direction which is the surface movement direction or feed advance direction by a value corresponding to $$Kz = s\left(1 - \frac{\alpha z \cdot n}{360}\right).$$

The calculated displacement may be fixed or the rollers may be mechanically supported in such a manner that such displacement is adjustable.

In the above formula Kz is the relative displacement distance in millimeters or fractions of millimeters between two adjacent rollers. s is the feed advance caused by each roller for each revolution of the work piece. $\alpha z$ is the roller inclusion angle of two adjacent rollers, namely, the angle included between the radial lines extending to the central rotational axis of the work piece and through the central, rotational axes of the smoothing rollers. n is the number of smoothing rollers effective on the circumference of a work piece which is contacted by the smoothing rollers.

It has been found according to the invention that the above teaching is applicable in the instance where the smoothing rollers are held in a common tool member or support and also where the smoothing rollers are supported by a plurality of tool support members. In such an instance, the independent or partial tool support members are axially displaced relative to each other or displaceable relative to each other, whereby again the above formula is applied for determining the relative displacement. It is not necessary, in both instances, that the relative displacement meets exactly the value obtained by the above formula. It has been found, that it is sufficient if the value determined by the formula is substantially satisfied. In any event, it has been found that the maximum roller feed advance of each individual smoothing roller may be utilized provided that the displacement is arranged as described above and this applies to a single roller support tool as well as to the embodiment comprising several roller supporting tool members.

In order to make the smoothing rollers or at least one smoothing roller adjustable in the axial direction relative to the other smoothing roller, it is suggested according to the invention that the adjustable smoothing roller is supported at its facing ends by an axially adjustable guide which simultaneously supports the roller. This type of structure is applicable to a single tool support as well as to the embodiment with several tool supports and in both instances it is possible to determine, or rather adjust, the axial roller position precisely for adaptation to individual requirements. This type of structure is especially advantageous if the individual rollers or groups of rollers supported by partial tool support members must be changed in their relative position relative to other rollers, for example when the diameter of the work piece changes, in order to achieve an optimal feed advance capacity. Where only a single tool support is employed the precise adjustment of the tool is also made possible while taking into account the working range of the tool in a simple manner.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE PRESENT INVENTION

Figure 1:
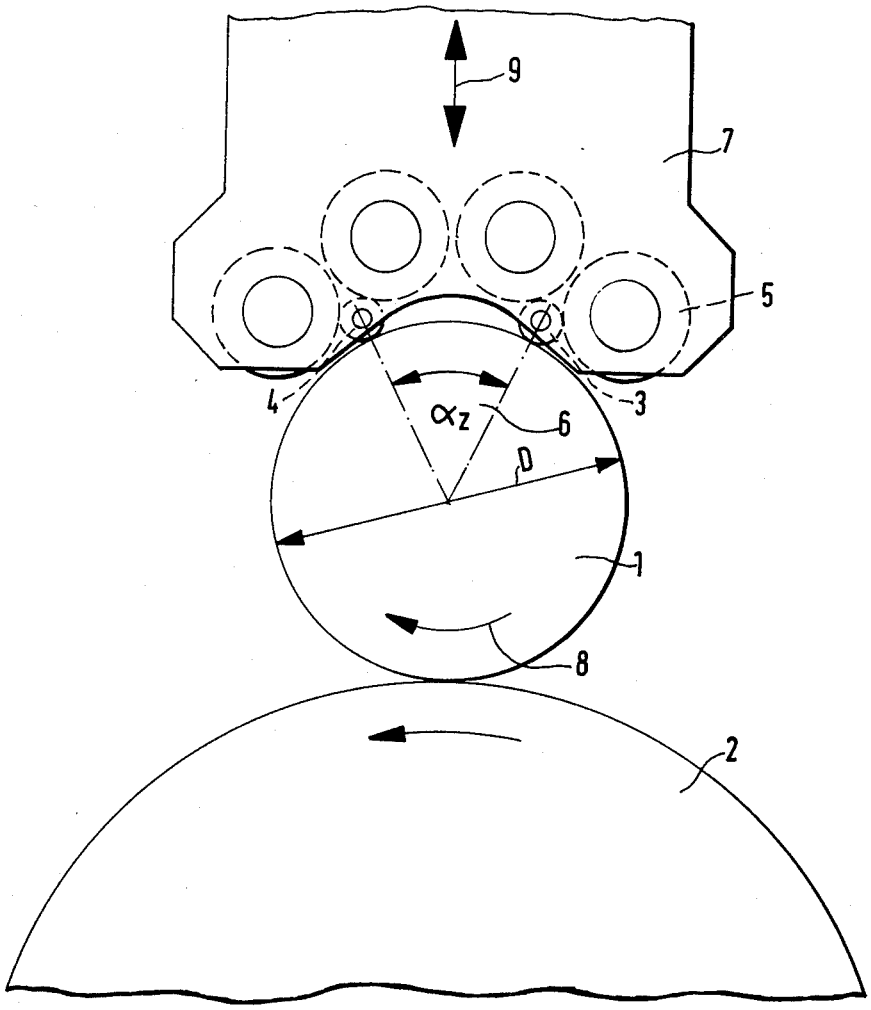
FIG. 1 is a somewhat schematic side view of a smoothing roller tool supporting two smoothing rollers and including one driving roller.

FIG. 1 shows a work piece 1 driven by a driving roller 2 for rotation in the direction of the arrow 8. Two smoothing rollers 3 and 4 are pressed against the work piece 1 by means of support rollers 5, for example, four of which are shown in FIG. 1. The support rollers 5 are rotatably supported in the tool carrier member or housing 7, whereby the smoothing rollers 3 and 4 are pressed against the work piece 1 with a suitable roller or rolling force as is known in the art.

For this purpose the tool support housing or member 7 is vertically displaceable as indicated by the arrow 9 for applying the necessary rolling force. If the smoothing rollers 3 and 4 contact the work piece 1 an angle 6 is enclosed by the lines which extend radially and interconnect the central rotational axis of the work piece 1 and the central rotational axis of the smoothing rollers 3 and 4. In the above mentioned equation for Kz the angle 6 is designated as $\alpha z$. Due to the diameter ratios of the smoothing rollers 3 and 4 relative to the driving roller 2, the latter does not cause any smoothing roller effect on the work piece 1 whereby the smoothing roller action or work is exclusively performed by the two smoothing rollers 3 and 4.

A roller arrangement of the type described so far is well known in the art. In the prior art arrangement the smoothing rollers 3 and 4 are located with their facing ends in precisely the same radially extending plane. Due to such arrangement only the feed advance capacity of the smoothing roller 4 is fully utilized for the indicated direction 8 of rotation. However, the feed advance capacity of the smoothing roller 3 cannot be utilized because its rolling track covers a large proportion of the rolling track of the smoothing roller 4 due to the arrangement of the smoothing roller 3, whereby an inefficient double rolling takes place.

The just mentioned disadvantage of the prior art is avoided according to the invention in that with due regard to the given direction of rotation the smoothing roller 4 is displaced in the direction backwardly or in the direction opposite to the feed advance direction. The same effect is achieved by displacing the smoothing roller 3 by a suitable spacing forwardly or in the feed advance direction as best seen in FIG. 3 which shows the suitable distance Kz calculated according to the above equation.

If one assumes in connection with the two roller arrangement according to FIG. 1 that each roller taken separately has a feed advance capacity of one millimeter for each revolutuion of the work piece, and if the angle 6 or $\alpha z$ enclosed by the radial lines of the two smoothing rollers are described above, includes an angle of 45° then, in order to calculate Kz the values $\alpha z = 45°$, $s = 1$ mm, and $n = 2$ are to be inserted into the above equation for Kz. Accordingly, Kz is calculated to correspond to 0.75 mm. Accordingly, either the smoothing roller 4 must be displaced rearwardly by 0.75 mm, taking into account the given direction 8 of rotation, or the smoothing roller 3 must be displaced forwardly by 0.75 mm. It has been found, that with this displacement surprisingly in an arrangement according to the invention the feed advance capacity is 2 mm per revolution of the work piece. Contrary thereto in an arrangement according to the prior art in which the facing ends of the smoothing rollers 3 and 4 are located in the same radial plane, the total feed advance capacity for each revolution is only 1.25 mm.

Figure 3:
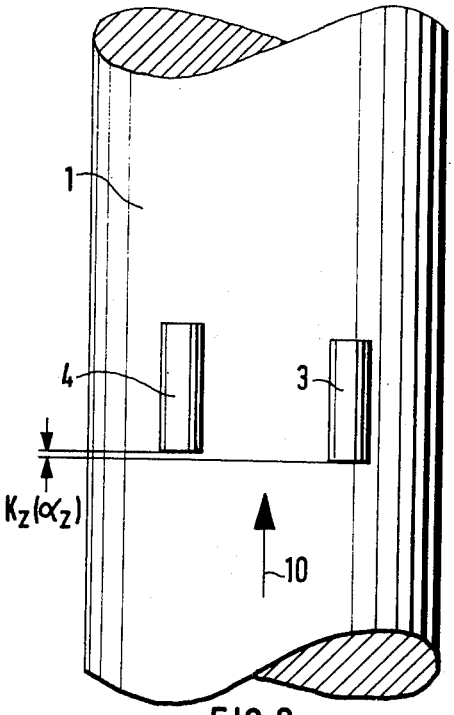
FIG. 3 shows the axial displacement relative to each other of the two smoothing rollers according to FIG. 1.

FIG. 3 shows the displacement of the rollers 3 and 4 relative to each other. It does not make any difference whether the feed advance moves in the direction of the arrow 10 by a powered displacement of the work piece 1 or whether the feed advance of the work piece 1 is accomplished by a certain angularity of the smoothing rollers 3 and 4 as disclosed in the above mentioned German Pat. No. 1,131,545. Incidentally, the smoothing rollers 3 and 4 are shown to be cylindrical. However, this is done only for simplicity's sake. In actuality, the smoothing rollers 3 and 4 may be somewhat conical by certain angular minutes as it is known in the art. Such slight angularity produces an imprint by the smoothing rollers on the work piece whereby the imprint has a somewhat drop shaped configuration.

Figure 2:
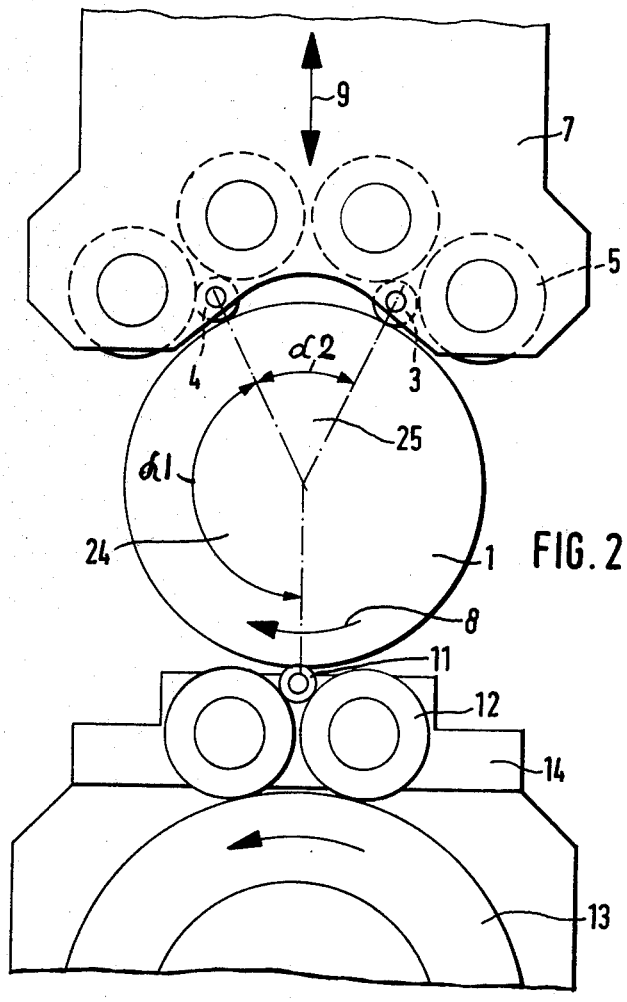
FIG. 2 shows a view similar to that of FIG. 1, however, of a smooth rolling mill comprising three smoothing rollers two of which are supported by an upper tool support member and one of which is supported by a separate lower tool support member.

In the embodiment shown in FIG. 2 the drive roller 2 shown in FIG. 1 is replaced by a further smoothing roller 11 supported by support rollers 12 which in turn are supported by a driving roller 13 which simultaneously drives the support rollers 12. The drive roller 13 may be obviated if the work piece 1 is driven instead by a conventional means.

Figure 5:
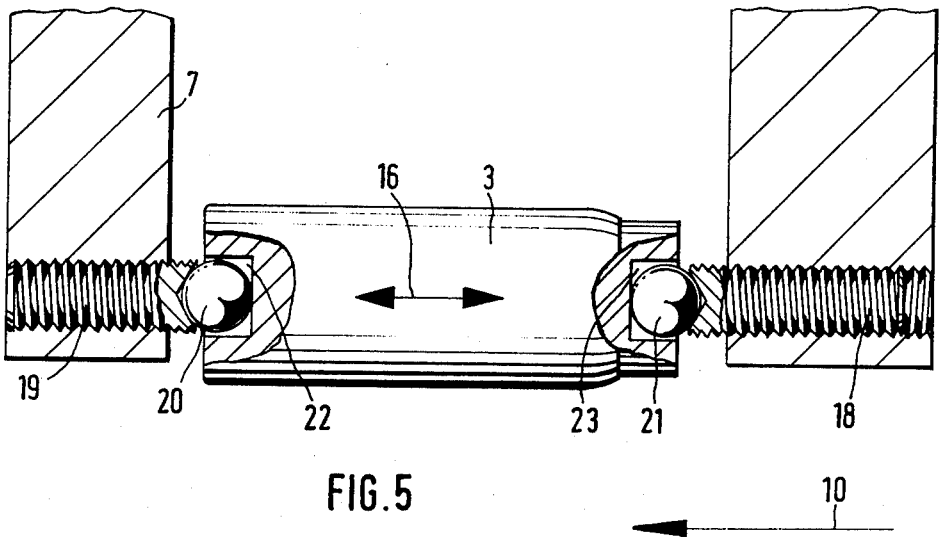
FIG. 5 shows an apparatus for the adjustment of the axial displacement of a smoothing roller whereby the arrangement is suitable for the type of displacement necessary in FIG. 3 or for the type of displacement necessary in FIG. 4.
Figure 6:
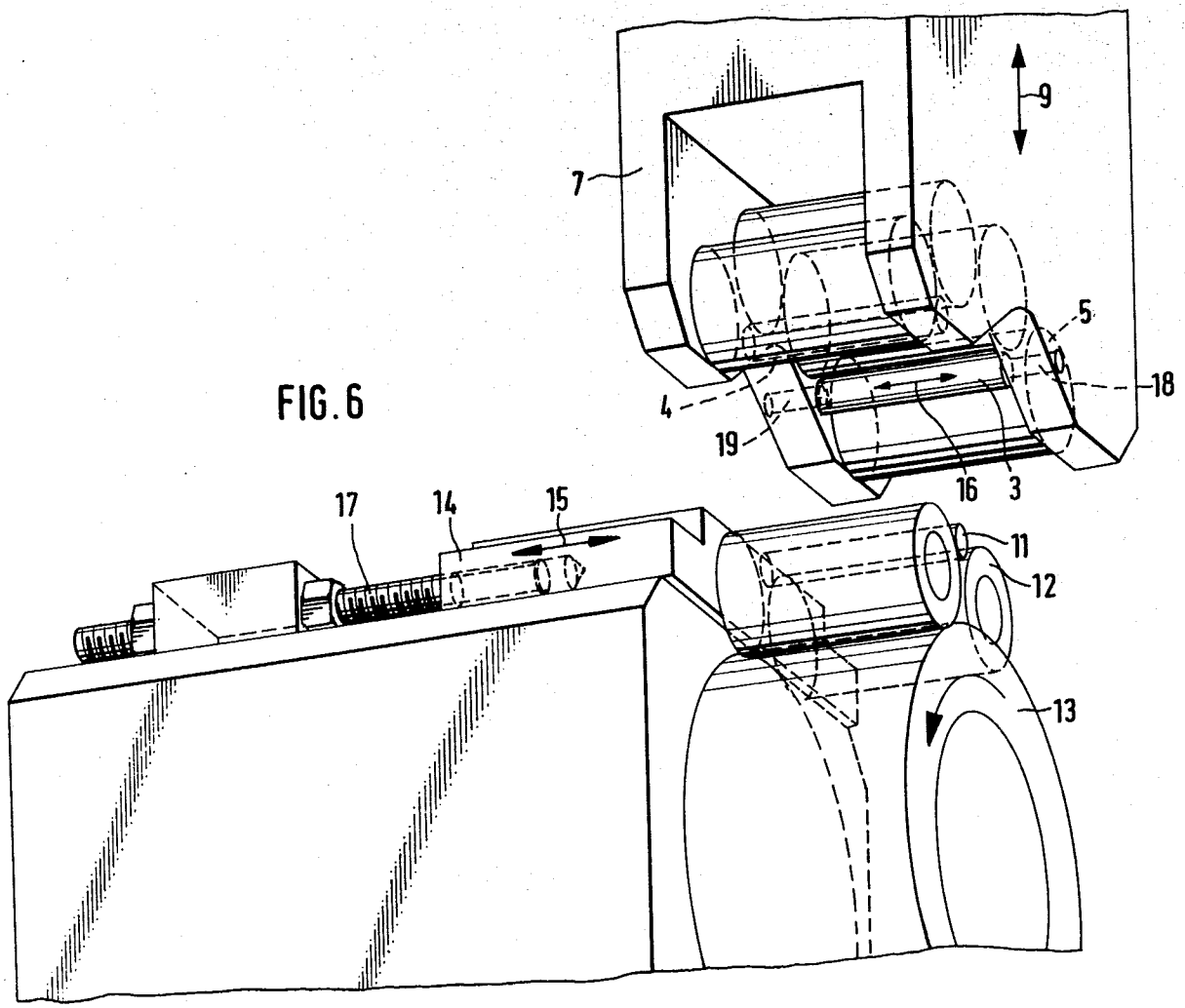
FIG. 6 is a perspective view of the arrangement illustrated in FIG. 2.

The perspective illustration in the embodiment of FIG. 6 illustrates the location of the upper and lower tools. According to the invention it is necessary that all smoothing rollers 3, 4, and 11 must be displaced relative to each other in the axial direction and with due regard or independent on their angular position relative to the work piece 1. Thus, it is necessary that the smoothing roller 11 is also displaced relative to the other two smoothing rollers 3 and 4. Such displacement, as in the first embodiment, may be a fixed displacement or the displacement may be adjustable by means illustrated in FIGS. 5 and 6. With the adjustment means illustrated in FIGS. 5 and 6 the axial position of the respective rollers may be adjusted to the desired extent.

In FIG. 6 the smoothing roller 11 is adjustable back and forth in the direction of the arrow 15 by means of an adjustment slide 14 which in turn is adjustable by means of a threaded spindle 17 for positioning the slide 14 into any desired axial position.

FIG. 5 shows a further example embodiment of an adjustment apparatus for the smoothing roller 3. The end faces of the smoothing roller 3 are provided with respective recesses 22 and 23 holding bearing balls 20 and 21. These bearing balls 20 and 21 cooperate with threaded spindles or bolts 19 and 18 respectively. By axially displacing these spindles 19 and 18 the smoothing roller 3 may be displaced axially in the direction of the arrow 16.

As may be seen from the above equation for Kz such axial adjustment is required only if the smoothing rollers form different angles $\alpha$, for example, due to differing work piece diameters. Where the structure of the smooth rolling apparatus is such that the smoothing rollers are not displaceable in the direction of the arrow 9, for example, but rather, are movable radially relative to the work piece, the respective angles will be the same relative to the work piece independently of the work piece. In order to calculate the relative position of the individual smoothing rollers to one another in accordance with the above stated equations, it is necessary that one of the rollers is selected as the reference roller with regard to its rotational direction. It is not relevant which roller is selected as the reference roller. For example, in the embodiment of FIG. 2 the smoothing roller 11 shall be considered to be the reference roller. Smoothing roller 11 in FIG. 2 forms the angle 24 with the Smoothing roller 4 as viewed in the rotational direction. The angle 24 is designated as $\alpha 1$. The smoothing rollers 3 and 4 form the angle 25 which is designated as $\alpha 2$. For simplicity's sake it is assumed that the angle $\alpha 2$ is of equal size as the angle $\alpha Z$ in FIG. 1. Hence: $\alpha 2 = \alpha Z = 45°$. It follows that in the arrangement of FIG. 2 the angle 24 or $\alpha 1$ is equal to 157.5°. Thus, in order to calculate the value for Kz the following values are to be inserted into the equation set forth above:

$$\alpha 1 = 157.5°$$

$$s = 1 \text{ mm}$$

$$n = 3.$$

For these values the respective Kz values is calculated to be 0.3125 mm. Taking the direction of rotation into account it is thus necessary that either the smoothing roller 11 is displaced backwardly relative to the smoothing roller 4 by the value of 0.3125 mm or the smoothing roller 4 is displaced forwardly by said value relative to the smoothing roller 11.

Figure 4:
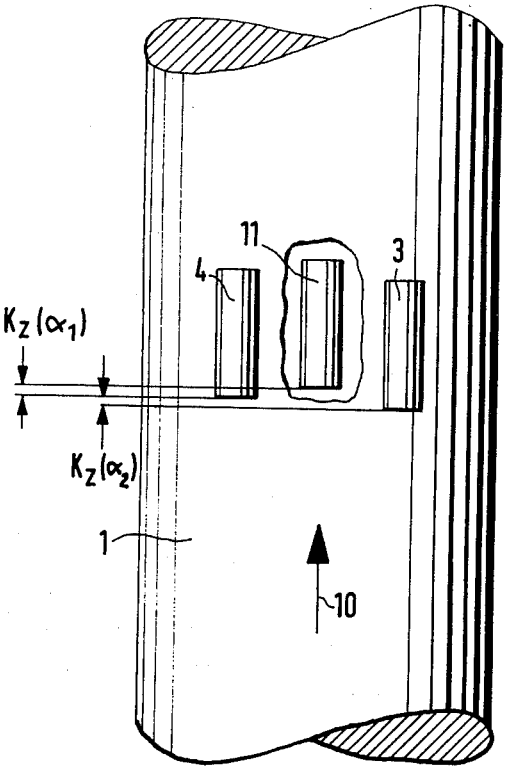
FIG. 4 shows the axial displacement of the three smoothing rollers according to FIG. 2.

The same calculation is repeated for the angle $\alpha 2$. Accordingly, the smoothing roller 3 is to be displaced forwardly relative to the smoothing roller 4 by a distance of 0.625 mm. If these values are maintained, the cumulative advance will be 3 mm per revolution of the work piece which means that the roller feed advance capacity of each roller 3, 4, and 11 is completely utilized. FIG. 4 illustrates the relative position of the smoothing rollers 3, 4, and 11 to each other in the axial direction indicated by the arrow 10.

Figure 7:
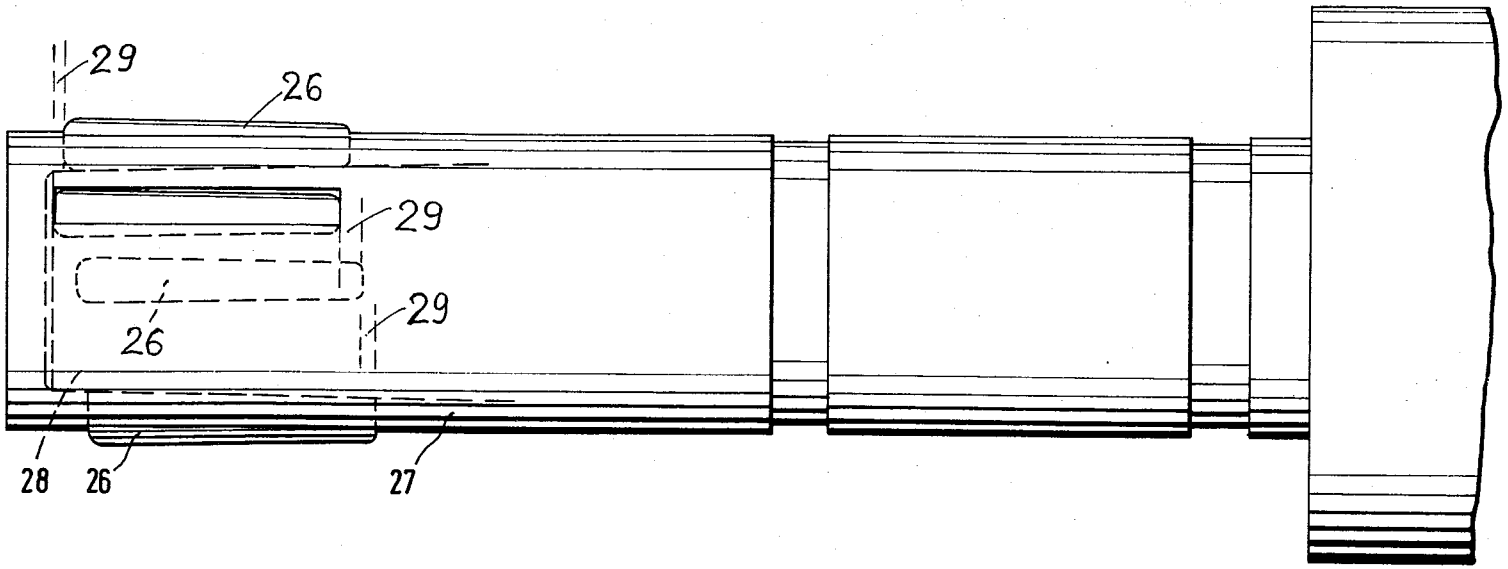
FIG. 7 shows an embodiment of a smoothing roller tool for smoothing internal cylinder surfaces with a plurality of smoothing rollers axially displaced relative to each other.

FIG. 7 illustrates an internal smoothing tool whereby the work piece in the form of a hollow cylinder is not shown. However, the smoothing rollers 26 are supported in a manner known as such on a support shaft or spindle 28. Additionally, the smoothing rollers 26 are guided in a cage 27. For example, the smoothing rollers 26 may be distributed about the circumference of the support spindle as is also known in the art, for example, in German Pat. No. 1,294,910. In order to achieve an optimal feed advance with tools of this type it is necessary that the smoothing rollers 26 are axially displaced relative to each other in the manner taught herein. The relative displacements are shown at 29 in FIG. 7. Such tools have a relatively narrow working range as far as diameter is concerned. Therefore, an axial adjustability of the individual smoothing rollers 26 is not necessary. It has been found, that arranging the smoothing rollers 26 in an axially rigid supporting structure is completely sufficient provided the axial displacement as disclosed herein is maintained.

The invention makes it possible for the first time to completely utilize the maximum feed advance capacity of each individual smoothing roller even when these smoothing rollers are not uniformly distributed about the circumference of the work piece to be smooth-rolled. Accordingly, the invention achieves a substantial improvement of the feed through capacity of tools of this type which are widely used in the art.

Although the invention has been described with reference to specific example embodiments, it will be appreciated, that it is intended, to cover all modifications and equivalents within the scope of the appended claims.

What is claimed is:

1. A smoothing rolling mill apparatus for smoothing roller action on a work piece mounted for rotation about a longitudinal central axis of the work piece, comprising a plurality of smoothing roller means, support means operatively supporting said roller means relative to said work piece, said roller means being distributed unevenly around the longitudinal central axis of said work piece, said support means holding said roller means in spaced positions such that a relative axial offset or displacement Kz is established between the facing ends of said roller means, and wherein said relative axial displacement Kz satisfies at least approximately the following equation:

$$Kz = s\left(1 - \frac{\alpha z \cdot n}{360}\right)$$

wherein s is the feed advance produced by each roller means for each rotation of the work piece, n is the number of roller means distributed about the work piece, and wherein $\alpha z$ is the angle enclosed by the two lines extending radially through said longitudinal central axis of said work piece and radially through the rotational axis of the respective roller means of two neighboring roller means whereby the full feed advance capacity of each said roller means is cumulatively effective.

2. The apparatus of claim 1, wherein said support means comprise at least two roller support components.

3. The apparatus of claim 1 or 2, further comprising adjustment means operatively connected to at least one of said roller means for adjusting the axial position of said roller means relative to each other.

4. The apparatus of claim 2, further comprising adjustment means operatively connected to at least one of said roller support components for adjusting the axial position of said one roller support component relative to another roller support component.

5. The apparatus of claim 1, wherein in a set of two roller means the first roller means (3), as viewed in the feed advance direction, is displaced rearwardly relative to the second roller means (4).

6. The apparatus of claim 2, wherein each support component carries at least one roller means whereby the first roller means, as viewed in the feed advance direction is displaced rearwardly relative to the second roller means.

7. The apparatus of claim 3, wherein said adjustment means comprise threaded means including threaded spindle means operatively arranged for said adjusting.

8. The apparatus of claim 4, wherein at least one of said roller support components comprises a slide member, and wherein said adjustment means comprise threaded means including threaded spindle means operatively connected to said slide member.

* * * * *